US011349211B2

(12) United States Patent
Yeom et al.

(10) Patent No.: US 11,349,211 B2
(45) Date of Patent: May 31, 2022

(54) ELECTRONIC DEVICE INCLUDING ANTENNA

(71) Applicant: Samsung Electronics Co., Ltd., Gyeonggi-do (KR)

(72) Inventors: Junghwan Yeom, Gyeonggi-do (KR); Hyungjoon Kim, Gyeonggi-do (KR); Jinsuk Jang, Gyeonggi-do (KR)

(73) Assignee: Samsung Electronics Co., Ltd

( * ) Notice: Subject to any disclaimer, the term of this patent is extended or adjusted under 35 U.S.C. 154(b) by 125 days.

(21) Appl. No.: 16/796,415

(22) Filed: Feb. 20, 2020

(65) Prior Publication Data

US 2021/0028543 A1 Jan. 28, 2021

(30) Foreign Application Priority Data

Jul. 24, 2019 (KR) ..... 10-2019-0089835

(51) Int. Cl.

*H01Q 5/30* (2015.01)
*H01Q 1/24* (2006.01)
*H01Q 9/04* (2006.01)

(52) U.S. Cl.

CPC ..... *H01Q 5/30* (2015.01); *H01Q 1/24* (2013.01); *H01Q 9/04* (2013.01); *H01Q 9/0421* (2013.01)

(58) Field of Classification Search

CPC ..... H01Q 5/30; H01Q 1/24; H01Q 9/0421; H01Q 9/04; H01Q 5/328; H01Q 1/243

USPC ..... 343/725

See application file for complete search history.

(56) References Cited

U.S. PATENT DOCUMENTS 6,456,250 B1 * 9/2002 Ying ..... H01Q 1/243 343/702
9,832,292 B2 11/2017 Moon
2012/0019415 A1 * 1/2012 Tseng ..... H01Q 5/20 343/700 MS
2013/0044030 A1 * 2/2013 Oh ..... H01Q 5/385 343/700 MS
2013/0207861 A1 * 8/2013 Huang ..... H01Q 13/10 343/767
2013/0225234 A1 * 8/2013 Cheng ..... H01Q 5/00 455/552.1
2015/0245513 A1 8/2015 Moon (Continued)

FOREIGN PATENT DOCUMENTS

KR 1020140036426 3/2014

OTHER PUBLICATIONS

"Samsung unveils 'Galaxy S10' proposing a new standard for smartphones", Feb. 21, 2019, pp. 14. https://news.samsung.com/kr/%ec%82%bc%ec%84%b1%ec%a0%84%ec%9e%90-%ec%8a%a4%eb%a7%88%ed%8a%b8%ed%8f%b0%ec%9d%98-%ec%83%88%eb%a1%9c%ec%9a%b4-%ea%b8%b0%ec%a4%80%ec%9d%84-%.

*Primary Examiner* — Hai V Tran
(74) *Attorney, Agent, or Firm* — The Farrell Law Firm, P.C.

(57) ABSTRACT

Disclosed is an electronic device which performs wireless communication and includes a first antenna configured to transmit and receive a signal in a first frequency band, a conductive member disposed to be spaced from the first antenna as much as a first distance, a printed circuit board disposed parallel to a first surface of the conductive member, and at least one conductive connection member interposed between the conductive member and the printed circuit board, wherein the conductive member is gap fed from the (Continued)

first antenna and operates as a radiator for wireless communication.

18 Claims, 10 Drawing Sheets

(56) References Cited

U.S. PATENT DOCUMENTS

| | | | | |
|---|---|---|---|---|
| 2016/0043467 | A1* | 2/2016 | Desclos | H01Q 19/005 343/745 |
| 2018/0342790 | A1* | 11/2018 | Oh | H01Q 9/42 |
| 2018/0358686 | A1 | 12/2018 | Park | |

* cited by examiner

ELECTRONIC DEVICE INCLUDING ANTENNA

CROSS-REFERENCE TO RELATED APPLICATION(S)

This application is based on and claims priority under 35 U.S.C. § 119 to Korean Patent Application No. 10-2019-0089835, filed on Jul. 24, 2019, in the Korean Intellectual Property Office, the disclosure of which is incorporated herein by reference in its entirety.

BACKGROUND

1. Field

The disclosure relates generally to an electronic device, and more particularly, to enhancing the radiation efficiency of an antenna in an electronic device including the antenna.

2. Description of Related Art

An electronic device, such as a smartphone or a tablet personal computer (PC), may transmit/receive data with an external device through wireless communication using an antenna. The electronic device may perform voice calls, message transmissions, and Internet searches, by using wireless communication data.

The performance of communication of the antenna mounted to the electronic device may vary depending on various elements. For example, when an element or a structure of a metal material is disposed around the antenna, the performance of communication of the antenna may be negatively influenced by the element or the structure.

When an element or a structure of a metal material is disposed around an antenna, a conventional electronic device prevents the degradation of the communication performance by disposing a radiator of the antenna to be maximally distant from the element or the structure or designing a pattern avoiding the element or the structure. For example, the element or the structure may be a portion of a camera module or a conductive member formed in the vicinity of the camera module.

The antenna of the electronic device is conventionally disposed to be physically close to a surrounding conductive member, thereby causing a decrease of the radiation efficiency of the antenna.

As such, there is a need in the art for an antenna structure of an electronic device that realizes increased radiation efficiency as compared to the conventional electronic device antenna.

SUMMARY

Aspects of the disclosure are to address at least the above-mentioned problems and/or disadvantages and to provide at least the advantages described below.

Accordingly, an aspect of the disclosure is to provide an electronic device that may utilize a conductive member (e.g., camera deco, as described below) around an antenna as a radiator, thereby precluding interference with the antenna.

Another aspect of the disclosure is to provide an electronic device that may utilize the conductive member formed in the vicinity of a camera module as a radiator by disposing the camera module or the conductive member and an antenna pattern close to each other, thereby increasing radiation efficiency and a radiation region of an antenna.

In accordance with an aspect of the disclosure, an electronic device may include a first antenna configured to transmit and receive a signal in a first frequency band, a conductive member disposed to be spaced from the first antenna as much as a first distance, a printed circuit board disposed parallel to a first surface of the conductive member, and at least one conductive connection member interposed between the conductive member and the printed circuit board, wherein the conductive member is gap fed from the first antenna and operates as a radiator for wireless communication.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
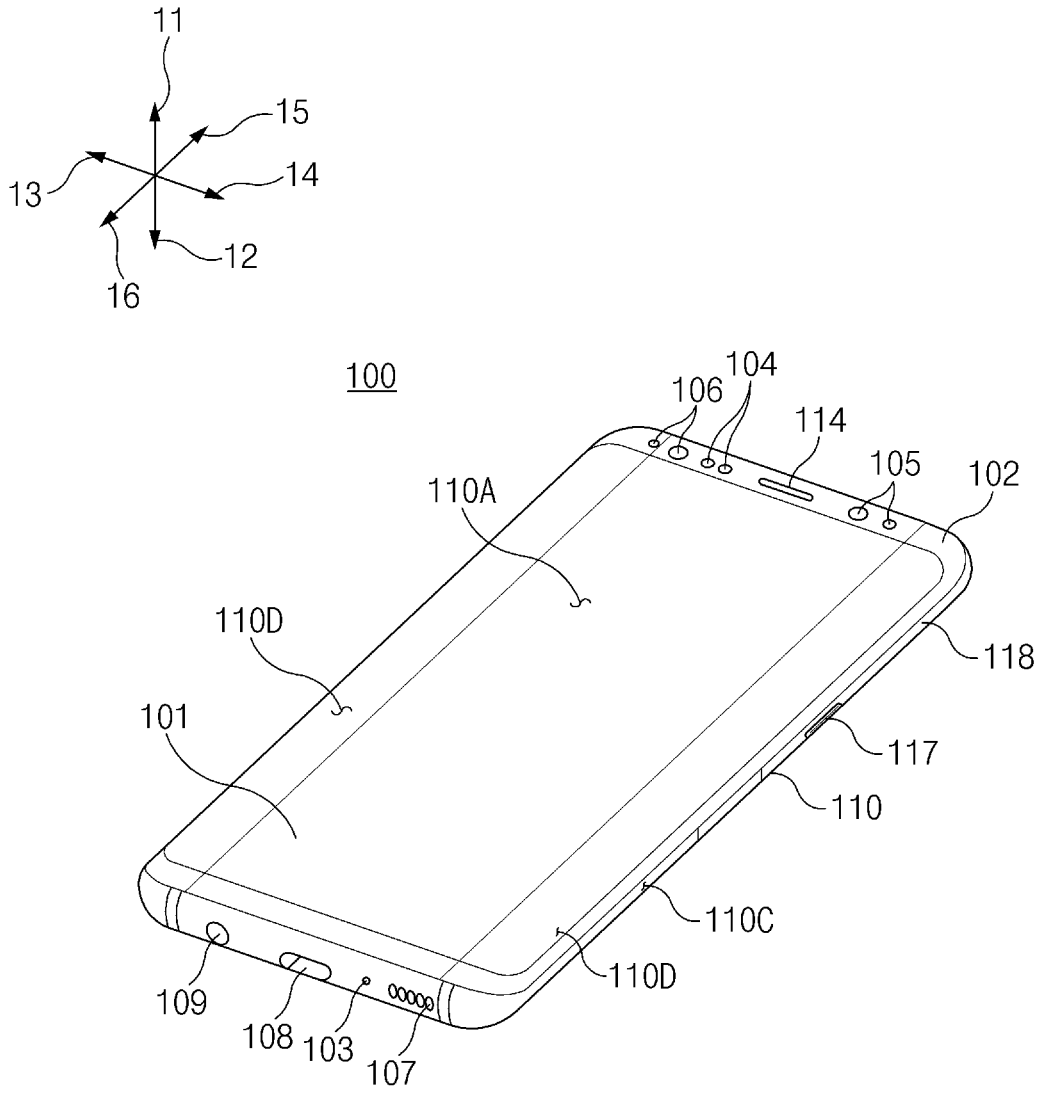
FIG. 1 is a front perspective view of a mobile electronic device according to an embodiment.

Embodiments of the disclosure will be described with reference to accompanying drawings. Accordingly, those of ordinary skill in the art will recognize that modifications, equivalents, and/or alternatives on the embodiments described herein can be made without departing from the scope and spirit of the disclosure. With regard to the description of drawings, similar components may be marked by similar reference marks/numerals. Descriptions of well-known functions and/or configurations will be omitted for the sake of clarity and conciseness.

It should be understood that embodiments of the disclosure and terms used in the embodiments are not intended to limit technical features disclosed in the disclosure to the particular embodiment disclosed herein. Rather, the disclosure should be construed to cover various modifications, equivalents, or alternatives of embodiments of the disclosure. With regard to description of drawings, similar or related components may be assigned with similar reference numerals. As used herein, singular forms of noun corresponding to an item may include one or more items unless the context clearly indicates otherwise.

Herein, each of the expressions "A or B", "at least one of A and B", "at least one of A or B", "A, B, or C", "one or more of A, B, and C", and "one or more of A, B, or C", may include any and all combinations of one or more of the associated listed items. Expressions such as "a first", "a second", "the first", or "the second", may be used merely for the purpose of distinguishing a component from other components, but do not limit the corresponding components in importance or order.

It is to be understood that if an element (e.g., a first element) is referred to, with or without the tern "operatively" or "communicatively coupled with", "coupled to", "connected with" or "connected to" another element (e.g., a second element), this indicates that the first element may be coupled with the second element directly (e.g., wiredly), wirelessly, or via a third element.

Figure 2:
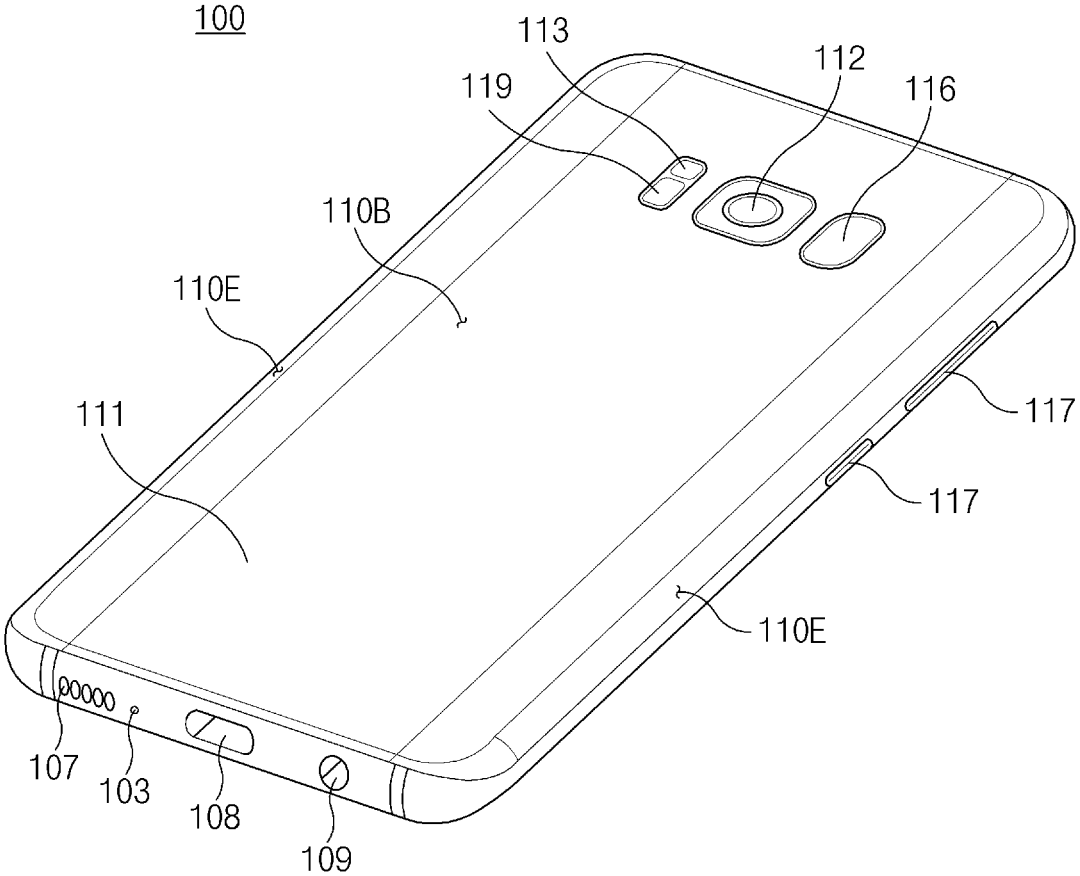
FIG. 2 is a rear perspective view of an electronic device of FIG. 1.

FIG. 1 is a front perspective view of a mobile electronic device according to an embodiment, and FIG. 2 is a rear perspective view of the electronic device of FIG. 1.

Referring to FIGS. 1 and 2, an electronic device 100 may include a housing 110 including a first surface (or a front surface or a surface facing a first direction 11) 110A, a second surface (or a rear or back surface or a surface facing a second direction 12) 110B, and a side surface 110C (or a surface facing third to sixth directions 13 to 16) surrounding a space between the first surface 110A and the second surface 110B. A housing may refer to a structure that forms a part of the first surface 110A, the second surface 110B, and the side surface 110C of FIG. 1.

The first surface 110A may be formed by a front plate 102 (e.g., a glass plate including various coating layers, or a polymer plate), of which at least a portion is substantially transparent. The second surface 110B may be formed by a back plate 111 that is substantially opaque. For example, the back plate 111 may be formed by a coated or colored glass, a ceramic, a polymer, a metal (e.g., aluminum, stainless steel (STS), or magnesium), or a combination of at least two of these materials. The side surface 110C may be coupled to the front plate 102 or the back plate 111 and may be implemented with a side bezel structure (or a "side member") 118 including metal and/or polymer. The back plate 111 and the side bezel structure 118 may be integrally formed and may include the same metal material, such as aluminum.

In FIG. 1, the front plate 102 may include two first regions 110D, which are bent toward the back plate 111 from the first surface 110A so as to be seamlessly extended, at opposite longitudinal edges of the front plate 102. As seen in FIG. 2, the back plate 111 may include two second regions 110E, which are bent toward the front plate 102 from the second surface 110B so as to be seamlessly extended, at the opposite longitudinal edges. The front plate 102 (or the back plate 111) may include only one of the first regions 110D or the second regions 110E. A portion of the first regions 110D or the second regions 110E may not be included. When viewed from a side surface of the electronic device 100, the side bezel structure 118 may have a first thickness (or width) on one side where the first regions 110D or the second regions 110E are not included, and may have a second thickness less than the first thickness on one side where the first regions 110D or the second regions 110E are included.

The electronic device 100 may include at least one of a display 101, an audio module (103, 107, 114), a sensor module (104, 116, 119), a camera module (105, 112, 113), key input devices 117, a light-emitting device 106, and a connector hole (108, 109). The electronic device 100 may not include at least one of these components or may further include any other suitable component.

The display 101 may be exposed through a considerable portion of the front plate 102. At least a portion of the display 101 may be exposed through the first surface 110A and the front plate 102, which forms the first regions 110D of the side surface 110C. A corner of the display 101 may be formed to be mostly identical to a shape of an outer portion of the front plate 102 adjacent to the corner of the display. To increase the area where the display 101 is exposed, a difference between the outer portion of the display 101 and an outer portion of the front plate 102 may be formed substantially identically.

A recess or an opening may be formed at a portion of a screen display region of the display 101, and at least one of the audio module 114, the sensor module 104, the camera module 105, and the light-emitting device 106 may be provided to be aligned with the recess or the opening. At least one of the audio module 114, the sensor module 104, the camera module 105, the fingerprint sensor 116, and the light-emitting device 106 may be provided on a back surface of the display 101, which corresponds to the screen display region. The display 101 may be disposed adjacent to or coupled to a touch sensing circuit, a pressure sensor capable of measuring the intensity (or pressure) of a touch, and/or a digitizer capable of detecting a magnetic stylus pen. At least a part of the sensor module (104, 119) and/or at least a part of the key input devices 117 may be disposed in the first regions 110D and/or the second regions 110E.

The audio module (103, 107, 114) may include the microphone hole 103 and the speaker hole (107, 114). A microphone for obtaining external sound may be disposed within the microphone hole 103. A plurality of microphones may be disposed to detect a direction of sound. The speaker hole (107, 114) may include the external speaker hole 107 and the receiver hole 114 for telephone calls, and may be implemented with one hole, or a speaker (e.g., a piezo speaker) may be included without the speaker hole (107, 114).

The sensor module (104, 116, 119) may generate an electrical signal or a data value that corresponds to an internal operation state of the electronic device 100 or corresponds to an external environment state. The sensor module (104, 116, 119) may include the first sensor module 104 (e.g., a proximity sensor) and/or a second sensor module (e.g., a fingerprint sensor) disposed on the first surface 110A of the housing 110, and/or the third sensor module 119 (e.g., a heart rate monitor (HRM) sensor) and/or the fourth sensor module 116 (e.g., a fingerprint sensor) disposed on the second surface 110B of the housing 110. The fingerprint sensor may be disposed on the second surface 110B as well as the first surface 110A (e.g., the display 101) of the housing 110. The electronic device 100 may further include a sensor module, such as at least one of a gesture sensor, a gyro sensor, a barometric pressure sensor, a magnetic sensor, an acceleration sensor, a grip sensor, a color sensor, an infrared (IR) sensor, a biometric sensor, a temperature sensor, a humidity sensor, and the illumination sensor 104.

The camera module (105, 112, 113) may include the first camera device 105 disposed on the first surface 110A of the electronic device 100, and the second camera device 112 and/or the flash 113 disposed on the second surface 110B. The camera module (105, 112) may include one or more lenses, an image sensor, and/or an image signal processor (ISP). The flash 113 may include a light-emitting diode or a xenon lamp. Two or more lenses (e.g., an infrared camera and wide-angle and telephoto lenses) and image sensors may be disposed on one surface of the electronic device 100.

The key input devices 117 may be disposed on the side surface 110C of the housing 110. The electronic device 100 may not include all or a part of the key input devices 117, and a key input device not included may be implemented on the display 101 in the form of a soft key. A key input device may include the sensor module 116 disposed on the second surface 110B of the housing 110.

The light-emitting device 106 may be disposed on the first surface 110A of the housing 110. The light-emitting device 106 may provide status information of the electronic device 100 in the form of light. The light-emitting device 106 may provide a light source that operates in conjunction with an operation of the camera module 105. The light-emitting device 106 may include a light-emitting diode (LED), an IR LED, and a xenon lamp.

The connector hole (108, 109) may include the first connector hole 108 capable of accommodating a universal serial bus (USB) connector for transmitting/receiving a power and/or data with an external electronic device, and/or the second connector hole (or an earphone jack) 109 capable of accommodating a connector for transmitting/receiving an audio signal with the external electronic device.

Figure 3:
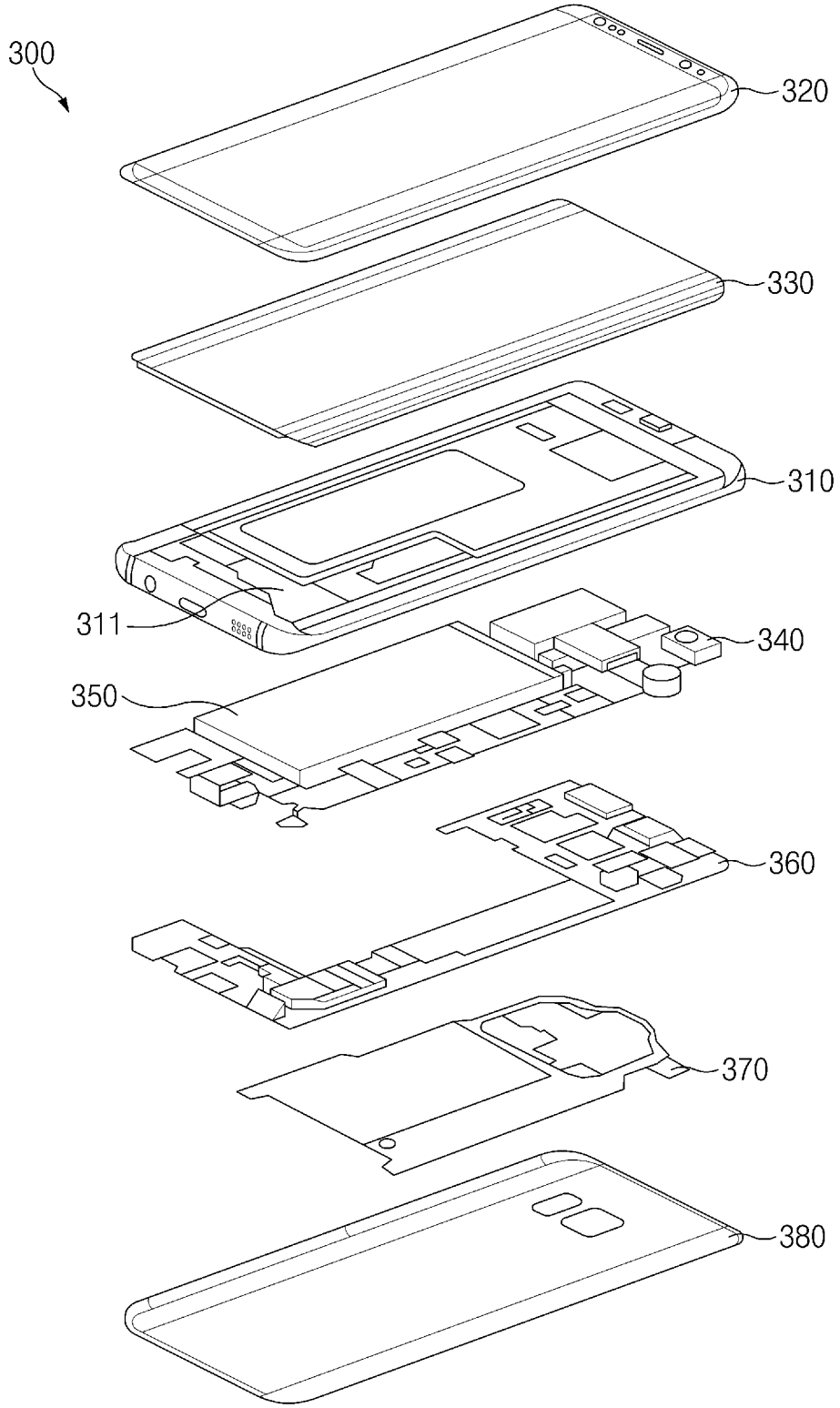
FIG. 3 is an exploded perspective view of an electronic device of FIG. 1.

FIG. 3 is an exploded perspective view of an electronic device of FIG. 1. Referring to FIG. 3, an electronic device 300 may include a side bezel structure 310, a first support member 311 (e.g., a bracket), a front plate 320, a display 330, a printed circuit board (PCB) 340, a battery 350, a second support member 360 (e.g., a rear case), an antenna 370, and a back plate 380. The electronic device 300 may not include at least one of these components or may further include any other suitable component. At least one of the components of the electronic device 300 may be identical or similar to at least one of the components of the electronic device 100 of FIG. 1 or 2, and thus, additional description will be omitted to avoid redundancy.

The first support member 311 may be disposed within the electronic device 300 so as to be connected with the side bezel structure 310 or may be integrally formed with the side bezel structure 310. The first support member 311 may be formed of a metal material and/or a nonmetal material (e.g., a polymer). The display 330 may be coupled to one surface of the first support member 311, and the PCB 340 may be coupled to an opposite surface of the first support member 311. A processor, a memory, and/or an interface may be mounted on the PCB 340. For example, the processor may include one or more of a central processing unit (CPU), an application processor (AP), a graphics processing device, an ISP, a sensor hub processor, and a communication processor (CP).

The memory may include a volatile memory or a non-volatile memory.

The interface may include a high definition multimedia interface (HDMI), a USB interface, a secure digital (SD) card interface, and/or an audio interface. The interface may electrically or physically connect the electronic device 300 with an external electronic device and may include a USB connector, an SD card/multimedia card (MMC) connector, or an audio connector.

The battery 350 supplies power to at least one component of the electronic device 300 and may include a primary cell incapable of being recharged, a secondary cell rechargeable, or a fuel cell. At least a portion of the battery 350 may be disposed on substantially the same plane as the PCB 340. The battery 350 may be integrally disposed within the electronic device 300, or may be disposed to be removable from the electronic device 300.

The antenna 370 may be interposed between the back plate 380 and the battery 350 and may include a near field communication (NFC) antenna, an antenna for wireless charging, and/or a magnetic secure transmission (MST) antenna. The antenna 370 may perform short range communication with an external device or may wirelessly transmit/receive a power necessary to charge. An antenna structure may be formed by at least one of a portion of the side bezel structure 310 and the first support member 311.

Figure 4:
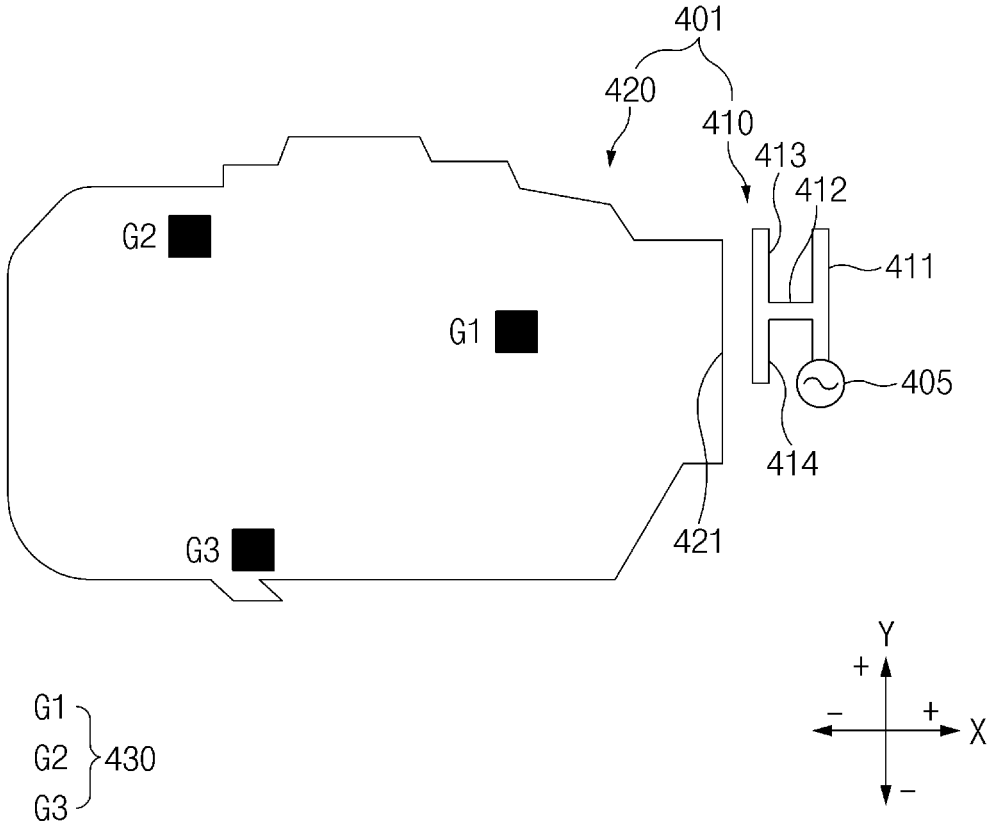
FIG. 4 illustrates an antenna structure according to an embodiment.

FIG. 4 illustrates an antenna structure according to an embodiment.

Referring to FIG. 4, an antenna structure 401 may include a first antenna 410 and a conductive member or plate (hereinafter, a "camera deco member") 420.

The first antenna 410 may include a feeding part 405, a first pattern 411, a second pattern 412, a third pattern 413, and a fourth pattern 414.

The feeding part 405 may be connected to the first pattern 411 or to a feeding point of a PCB.

The first pattern 411 may be a conductive branch that is extended from the feeding part 405 to face a first direction (e.g., Y+). The first pattern 411 may form a first electrical path for transmitting/receiving wireless data.

The second pattern 412 may connect the third pattern 413 and the fourth pattern 414 to the first pattern 411. The second pattern 412 may be extended to face a second direction (e.g., X+, X−) perpendicular to the first direction.

The third pattern 413 and the fourth pattern 414 may be conductive branches that are connected to the second pattern 412 and are extended from the second pattern 412 to face different directions. For example, the third pattern 413 may be extended from the second pattern 412 to face the first direction (e.g., Y+) that is identical to a direction in which the first pattern 411 is extended. The fourth pattern 414 may be extended from the second pattern 412 to face a third direction (e.g., Y−) that is opposite to the direction in which the first pattern is extended.

An example is illustrated in FIG. 4 as the first antenna 410 is "H"-shaped, but the disclosure is not limited thereto. For example, the first antenna 410 may have a shape in which at least one branch of the third pattern 413 or the fourth pattern 414 is not included.

The third pattern 413 and the fourth pattern 414 may be disposed adjacent to the camera deco member 420 and may maintain a specified distance from a coupling feeding part 421 of the adjacent camera deco member 420.

The third pattern 413 and the fourth pattern 414 may have a shape corresponding to the coupling feeding part 421 of the camera deco member 420. For example, when the coupling feeding part 421 is in the shape of a straight line, the third pattern 413 and the fourth pattern 414 may be in the shape of a straight line that is parallel to the coupling feeding part 421 and is spaced from the coupling feeding part 421 as much as the specified distance. When the coupling feeding part 421 is in the shape of a curve, the third pattern 413 and the fourth pattern 414 may be in the shape of a curve that is parallel to the coupling feeding part 421 and is spaced from the coupling feeding part 421 as much as the specified distance.

The camera deco member 420 may be disposed adjacent to the first antenna 410, and may be a metal plate that causes only a portion of a surrounding element or component to be viewable from the outside. For example, the camera deco member 420 may be a plate that prevents a portion of a camera module from being exposed to the outside. In this case, the camera deco member 420 may include a hole, and a lens of the camera module may be exposed to the outside through the hole.

The camera deco member 420 may be a structure that is adhered or joined to a back surface of a housing such that a camera module is not exposed to the outside at a back surface of an electronic device. The camera deco member 420 may be implemented with a tape, separate metal pattern welding, or double-shot injection molding.

The camera deco member 420 may be utilized as a path for preventing static electricity applied to the outside. The camera deco member 420 may be utilized as a radiator for wireless communication by using a coupling feeding manner. The camera deco member 420 may include the coupling feeding part 421 that is spaced from the third pattern 413 and the fourth pattern 414 of the first antenna 410 as much as a specified distance. The camera deco member 420 may be fed through the third pattern 413 and the fourth pattern 414 in a coupling manner.

One surface (or a first surface) of the camera deco member 420 may face a PCB in the electronic device 300. The first surface of the camera deco member 420 may be connected to at least one conductive connection member (e.g., a gasket, a C-clip, or a contact switch) (G1 to G3) 430. Below, a description will be given with reference to when the at least one conductive connection member 430 is a conductive gasket, but the disclosure is not limited thereto. FIG. 4 illustrates three gaskets 430 connected to the camera deco member 420, but the disclosure is not limited thereto. For example, only the first gasket G1 may be connected to the camera deco member 420.

The gaskets 430 may connect the first surface of the camera deco member 420 to a ground. The gaskets 430 may operate as a short-circuited line (or a ground connection part) for allowing the camera deco member 420 to operate as a radiator for wireless communication.

Figure 5:
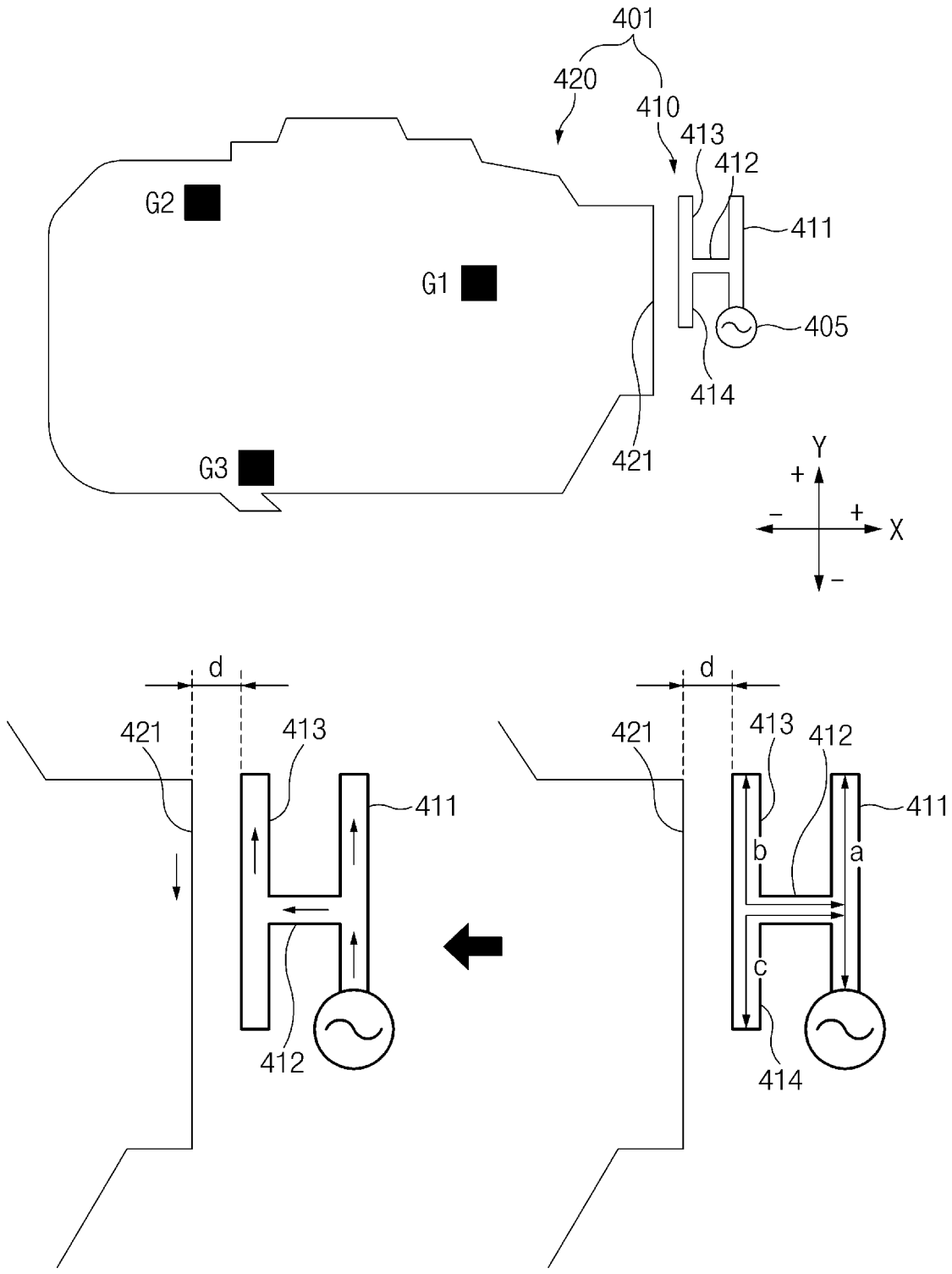
FIG. 5 illustrates how a camera deco member operates as a radiator according to an embodiment.

FIG. 5 illustrates how a camera deco member operates as a radiator according to an embodiment.

Referring to FIG. 5, the antenna structure 401 may include the first antenna 410 and the camera deco member 420.

The first antenna 410 may include the feeding part 405, the first pattern 411, the second pattern 412, the third pattern 413, and the fourth pattern 414.

The first pattern 411 may form a first electrical path "a" for transmitting/receiving a signal of a specified target frequency. The second pattern 412 and the third pattern 413 may form a second electrical path "b". The second pattern 412 and the fourth pattern 414 may form a third electrical path "c". The second electrical path "b" or the third electrical path "c" may be for operating the camera deco member 420 as a radiator.

The first electrical path "a" (or a length of the first pattern 411) may be used as a reference for determining the second electrical path "b" (or a sum of a length of the second pattern 412 and a length of the third pattern 413), and the third electrical path "c" (or a sum of a length of the second pattern 412 and a length of the fourth pattern 414).

For example, the first to third electrical paths a to c may have a relationship based on Equation (1) as follows.

$$a<(b \text{ or } c)<(a+\lambda/4) \quad (1)$$

In Equation (1), λ is a wavelength of a resonant frequency by a first electrical path "a".

Gap feeding may occur between the third pattern 413 and the fourth pattern 414 (hereinafter, a "coupling pattern") and the coupling feeding part 421 of the camera deco member 420. A spaced distance "d" between the coupling pattern (413, 414) and the coupling feeding part 421 of the camera deco member 420 may be maintained. When the spaced distance "d" decreases, a coupling coefficient may increase, and the coupling pattern (413, 414) may operate as a voltage source.

When the first antenna 410 or the camera deco member 420 operates as a radiator for wireless communication, current may flow in the first pattern 411 and the third pattern 413 in the same direction. For example, current may flow in both the first pattern 411 and the third pattern 413 in the first direction Y+.

When the first antenna 410 or the camera deco member 420 operates as a radiator for wireless communication, current may flow in the third pattern 413 in the first direction Y+. At the coupling feeding part 421 of the camera deco member 420, current may flow in the third direction Y− opposite to the first direction Y+.

Figure 6:
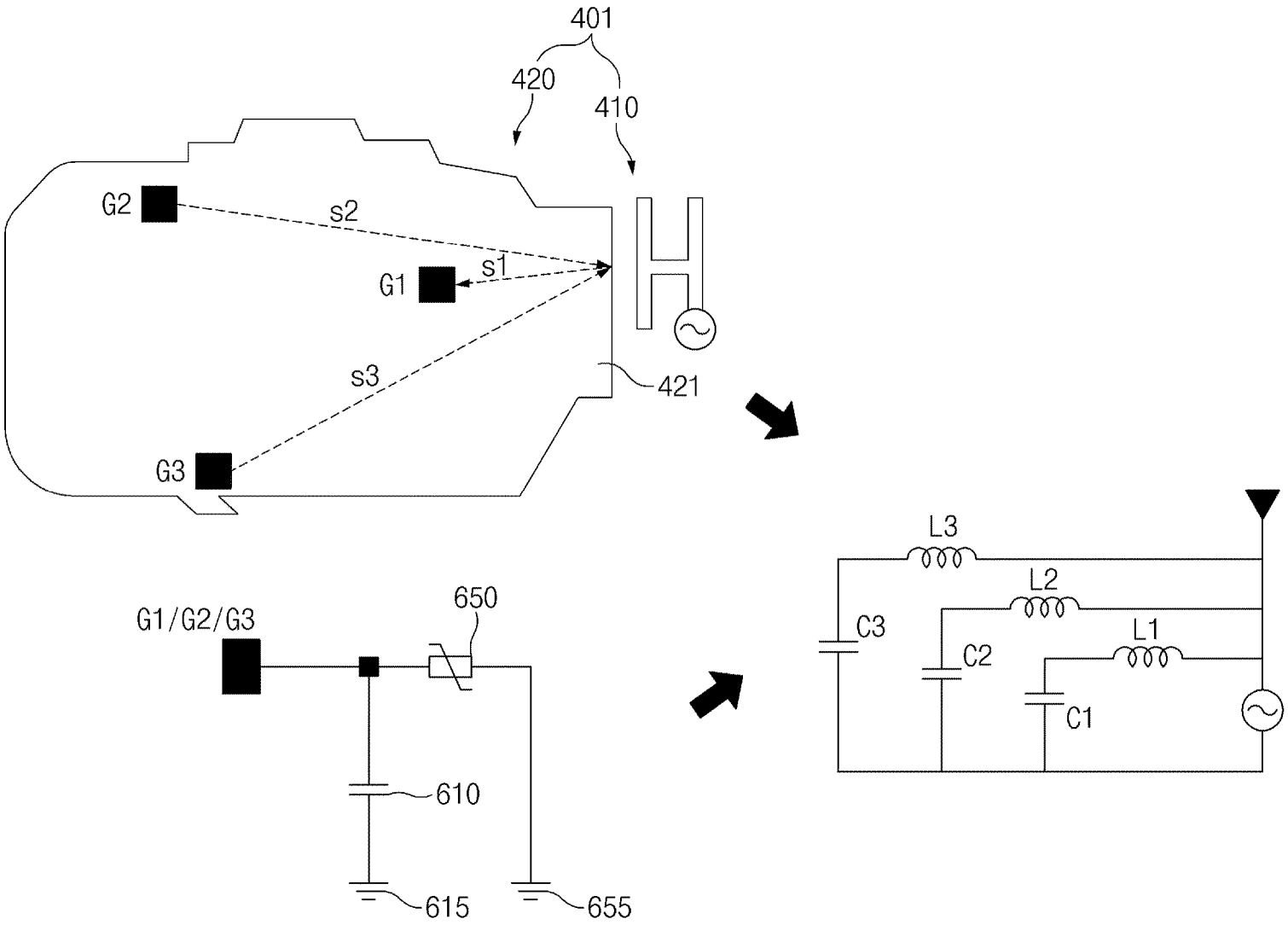
FIG. 6 illustrates an electrical path of a camera deco member based on a location of a gasket according to an embodiment.

FIG. 6 illustrates an electrical path of a camera deco member according to a location of a gasket G1, G2, or G3 according to an embodiment. An electrical path according to a location of the gasket G1, G2, or G3 may include inductance and capacitance characteristics (or components).

Referring to FIG. 6, the camera deco member 420 may be connected to at least one of gaskets G1, G2, and G3. FIG. 6 illustrates three gaskets G1, G2, and G3 are connected to the camera deco member 420, but the disclosure is not limited thereto. The gaskets G1, G2, and G3 may be variously disposed depending on a design environment, an arrangement relationship of surrounding components, or a communication environment.

An inductance may be formed based on a distance from the gasket G1, G2, or G3 to the coupling feeding part 421 (or the first antenna 410).

For example, the first gasket G1 may be disposed to be spaced from the coupling feeding part 421 as much as a first distance s1. In this case, a first inductance L 1 corresponding to the first distance s 1 may be formed. The second gasket G2 may be disposed to be spaced from the coupling feeding part 421 as much as a second distance s2. In this case, a second inductance L2 corresponding to the second distance s2 may be formed. The third gasket G3 may be disposed to be spaced from the coupling feeding part 421 as much as a third distance s3. In this case, a third inductance L3 corresponding to the third distance s3 may be formed.

Each of the gaskets G1, G2, and G3 may operate as a short-circuited line (or a ground connection part) for allowing the camera deco member 420 to operate as a radiator for wireless communication. The gaskets G1, G2, and G3 may be connected to a ground 655 (e.g., a bracket) through a protection element (e.g., an electrostatic discharge (ESD) diode) 650 for preventing a leakage current.

Each of the gaskets G1, G2, and G3 may be connected to a ground 615 of a PCB and may be connected to the ground 615 of the PCB through a capacitor 610 placed on an electrical path between each of the gaskets G1, G2, and G3 and the ground 615 of the PCB. The capacitor 610 may be used to radiate current flowing in the camera deco member 420.

Resonance for signals in various frequency bands may be made by inductances L 1, L2, and L3 formed depending on locations of the gaskets G 1, G2, and G3 or capacitances C 1, C2, and C3 of the capacitor 610. A resonant frequency or radiation efficiency may be improved by designing a short-circuited line of an equivalent-planar inverted-F antenna (PIFA)-deco coupled by the inductances L1, L2, and L3 or the capacitances C1, C2, and C3.

For example, in the first gasket G1, resonance for a signal in a first frequency band may be made by L 1 or C 1 being a characteristic of a first path. In the second gasket G2, resonance for a signal in a second frequency band may be made by L2 or C2 being a characteristic of a second path. In the third gasket G3, resonance for a signal in a third frequency band may be made by L3 or C3 being a characteristic of a third path. The first to third frequency bands may be different or the same frequency bands.

Figure 7:
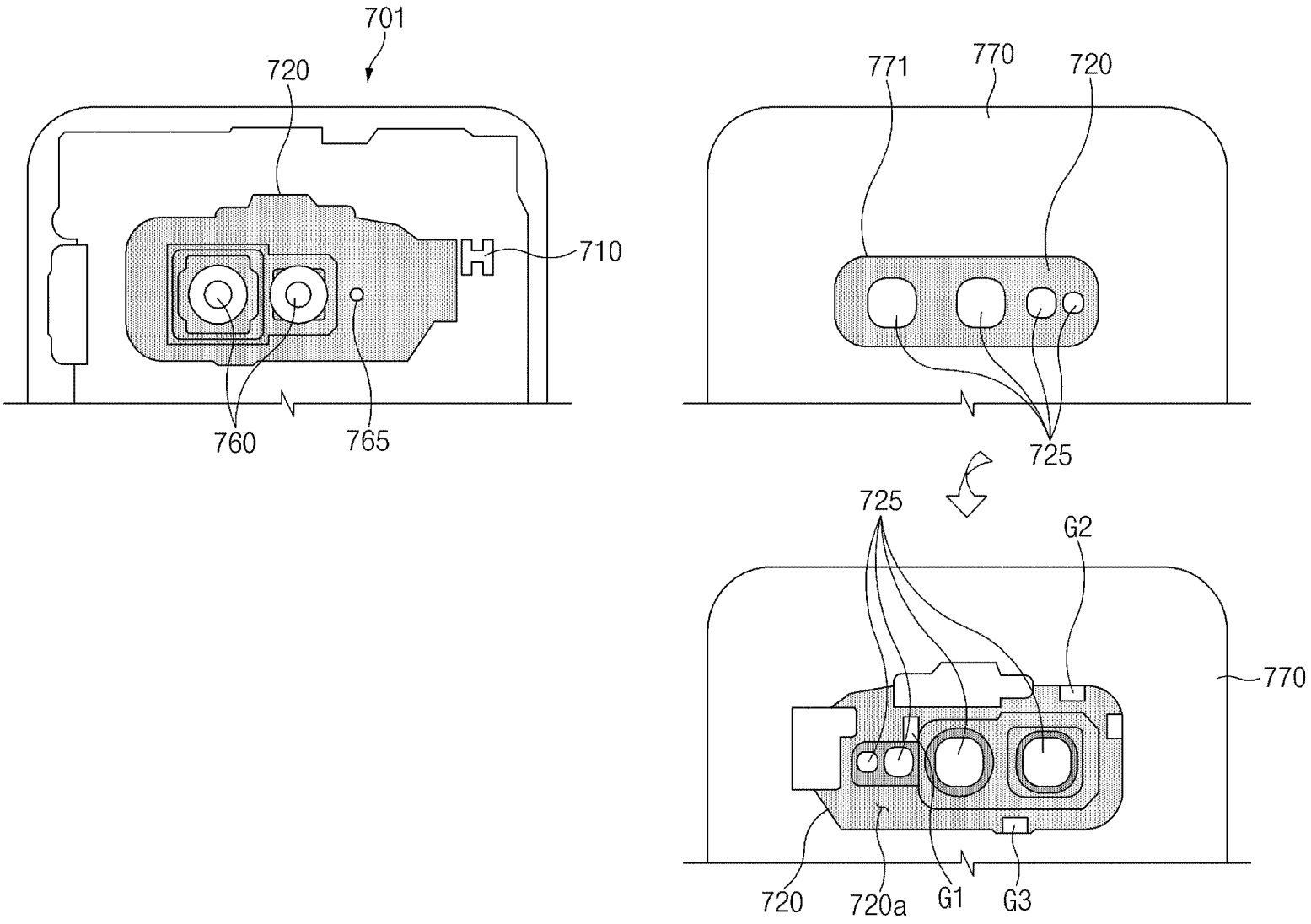
FIG. 7 illustrates implementation of an antenna structure according to an embodiment.

FIG. 7 illustrates how an antenna structure is implemented. FIG. 7 according to an embodiment.

Referring to FIG. 7, an electronic device 701 may include a first antenna 710 and a camera deco member 720. The first antenna 710 and the camera deco member 720 may be disposed to be spaced from each other as much as a specified distance and to be adjacent to each other. The first antenna 710 or the camera deco member 720 may be used as a radiator for wireless communication.

The camera deco member 720 may be attached to an inner surface of a case 770 of the electronic device 701. A portion of the camera deco member 720 may be exposed to the outside through a hole 771 formed in the case 770.

The camera deco member 720 may include at least one hole 725. The case where the camera deco member 720 includes four holes 725 is illustrated in FIG. 4, but the disclosure is not limited thereto. For example, a lens of a camera 760 or a sensing surface of a sensor 765 may be exposed to the outside through the hole 725.

A first surface 720*a* of the camera deco member 720 may face a PCB in the electronic device 701 and may be connected to at least one gasket G1, G2, or G3. The gasket G1, G2, or G3 may operate as a short-circuited line (or a ground connection part) for allowing the camera deco member 720 to operate as a radiator for wireless communication.

Figure 8:
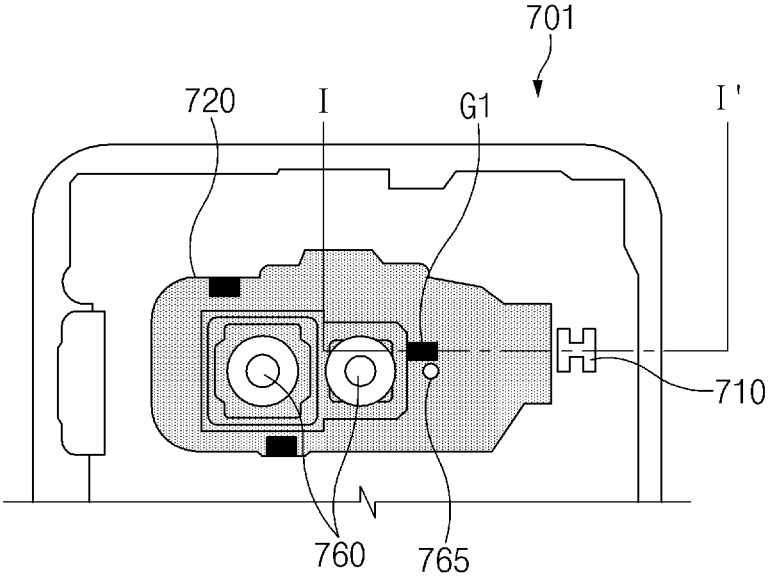
FIG. 8 is a cross-sectional view of a first antenna and a camera deco member according to an embodiment.
Figure 8:
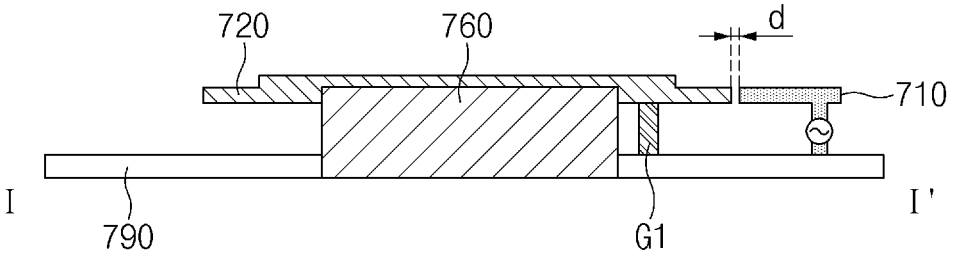

FIG. 8 is a cross-sectional view of a first antenna or a camera deco member according to an embodiment.

Referring to FIG. 8, the electronic device 701 may include the first antenna 710 and the camera deco member 720. The first antenna 710 and the camera deco member 720 may be disposed to be spaced from each other as much as a specified distance and to be adjacent to each other. The first antenna 710 and the camera deco member 720 may be used as a radiator for wireless communication.

In a cross-section view taken along I-I', the camera 760 may be mounted on a PCB 790. A portion (e.g., a lens) of the camera 760 may be exposed to the outside through a hole formed at the camera deco member 720. Another portion (e.g., a peripheral part of a lens or a wire) of the camera 760 may be covered by the camera deco member 720.

The camera deco member 720 may be disposed on the camera 760. A coupling feeding part of the camera deco member 720 may be spaced from the first antenna 710 as much as the specified distance "d".

The gasket G1 may be interposed between the camera deco member 720 and the PCB 790. A first end (or end portion) of the gasket G1 may be connected to the camera deco member 720, and a second end (or end portion) of the gasket G1 may be connected to the PCB 790. One point of the PCB 790, to which the second end of the gasket G1 is connected, may be connected to a ground of the PCB 790 through a separate capacitor.

The gasket GI may be disposed to be spaced from the first antenna 710 as much as λ or more. "λ" may be a wavelength of a resonant frequency of the first antenna 710.

Figure 9:
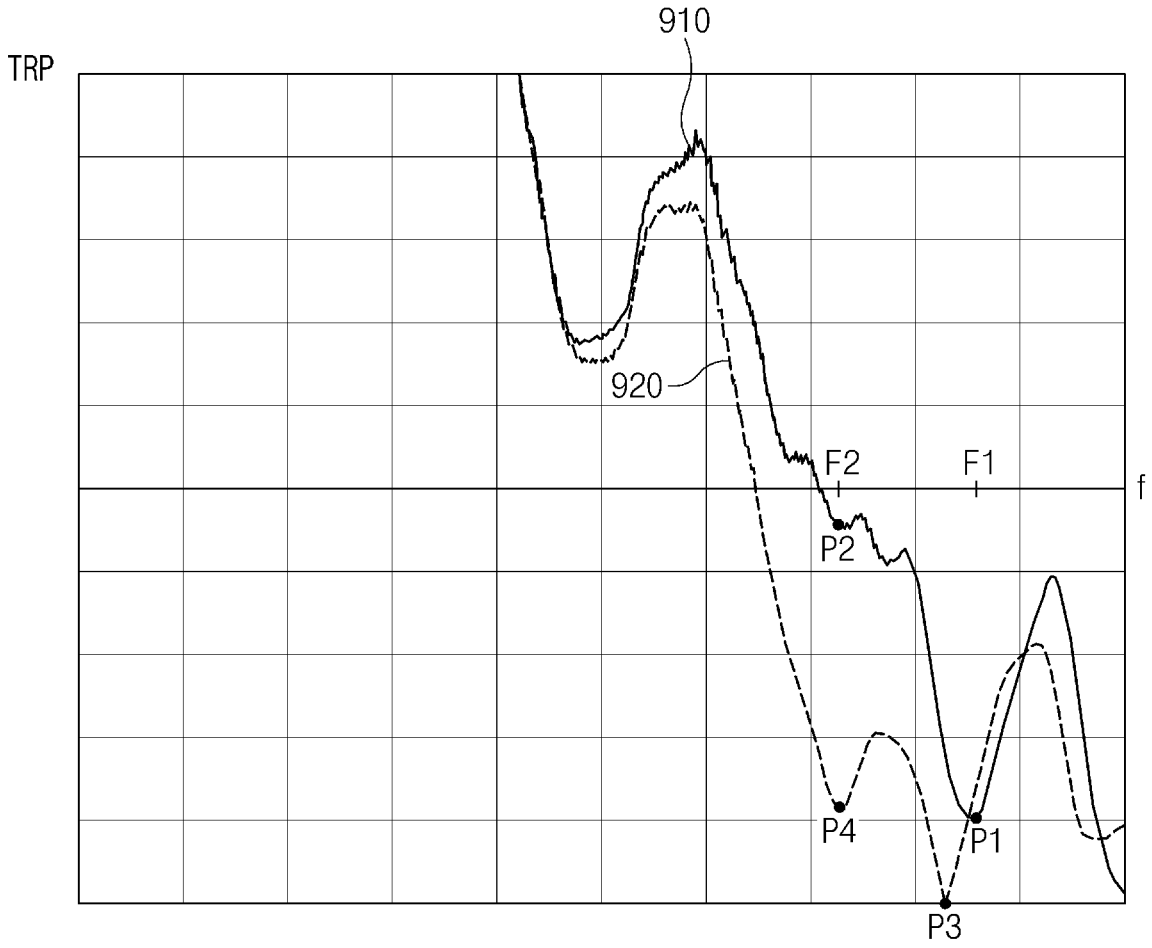
FIG. 9 illustrates radiation performance of a first antenna and a camera deco member according to an embodiment.

FIG. 9 illustrates radiation performance of a first antenna or a camera deco member according to an embodiment.

Referring to FIG. 9, in a first state 910 in which the camera deco member 420 or 720 is not utilized as a radiator for wireless communication, a signal of a specified first frequency F1 may be transmitted/received by the first antenna 410 or 710. In the first state 910, a total radiated power (TRP) for the first frequency F1 may have a first value P1 at which wireless communication performance is secured.

In the first state 910, the camera deco member 420 or 720 may not operate as a radiator or may be an element hindering a radiation operation of the first antenna 410 or 710. As such, the total radiated power (TRP) for a second frequency F2 adjacent to the first frequency F1 may have a second value P2 that is relatively low. In this case, the performance of wireless communication using the second frequency F2 may be reduced.

In a second state 920 in which the camera deco member 420 or 720 is utilized as a radiator, a signal of the specified first frequency F1 may be transmitted/received by the first antenna 410 or 710. When the camera deco member 420 or 720 is utilized as a radiator, the camera deco member 420 or 720 does not hinder a radiation operation of the first antenna 410 or 710, and thus, the performance of wireless communication using the first frequency F1 is improved. For example, in the second state 920, the TRP for the first frequency F1 (or a frequency similar to the first frequency F1) may have a third value P3 being greater than the first value P 1 in the first state 910.

In the second state 920, the camera deco member 420 or 720 may be used as a radiator, in which case the TRP for the second frequency F2 adjacent to the first frequency F1 may have a fourth value P4 being greater than the second value P2 in the first state 910.

In the second state 920, a beam coverage of the first antenna 410 or 710 or the camera deco member 420 or 720 may be expanded compared to the first state 910. As the camera deco member 420 or 720 is utilized as a radiator, the degree of freedom of an antenna pattern design may increase.

Figure 10:
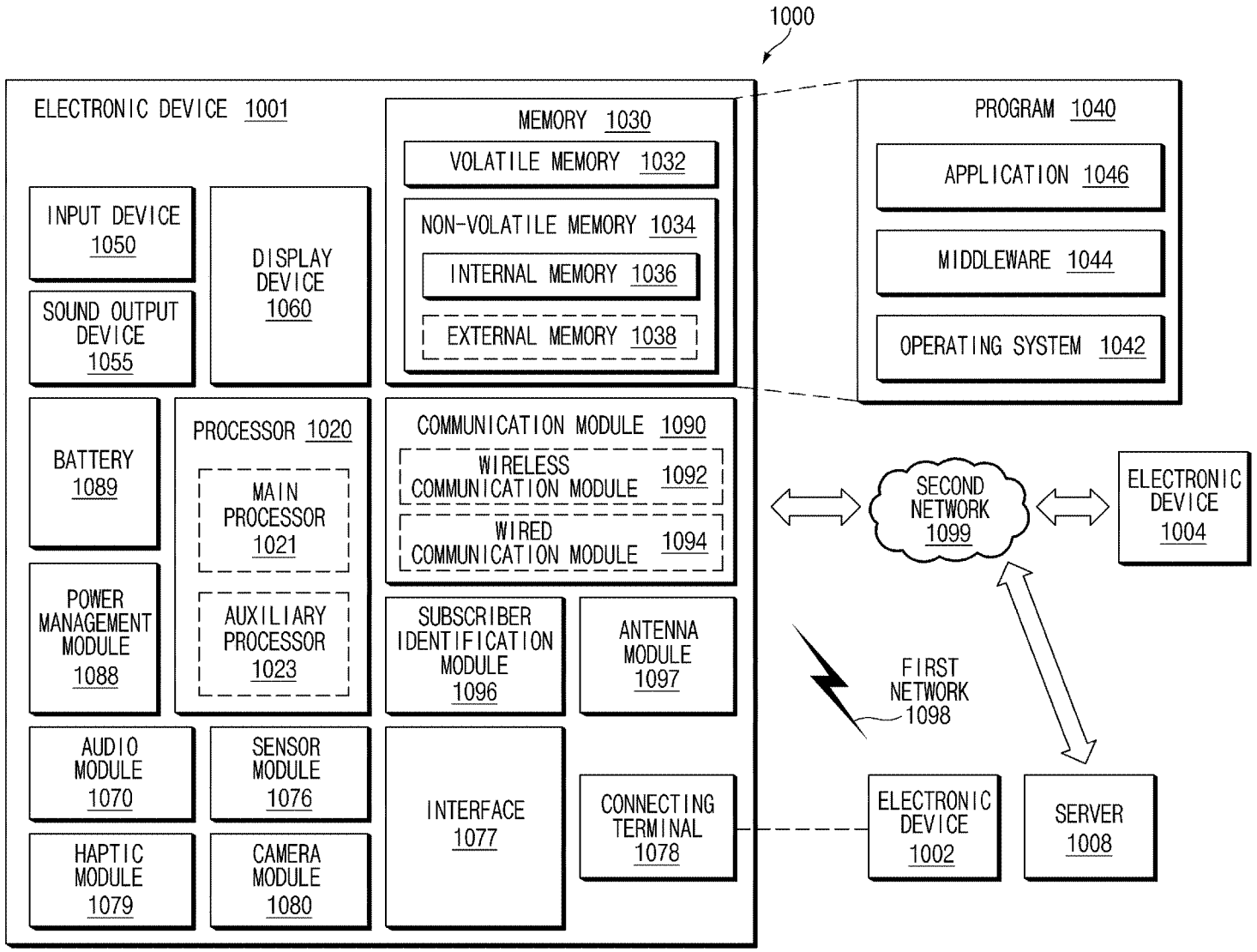
FIG. 10 is a block diagram illustrating an electronic device in a network environment according to an embodiment.

FIG. 10 is a block diagram of an electronic device 1001 in a network environment 1000, according to an embodiment. The electronic device may include at least one of a smartphone, a tablet PC, a mobile phone, a video telephone, an electronic book reader, a desktop PC, a laptop PC, a netbook computer, a workstation, a server, personal digital assistant (PDA), a portable multimedia player (PMP), a motion picture experts group (MPEG-1 or MPEG-2) audio layer 3 (MP3) player, a mobile medical device, a camera, or a wearable device. A wearable device may include at least one of an accessory type of device (e.g., a timepiece, a ring, a bracelet, an anklet, a necklace, glasses, a contact lens, or a head-mounted device (HMD)), a one-piece fabric or clothes type of device (e.g., electronic clothes), a body-attached type of device (e.g., a skin pad or a tattoo), or a bio-implantable type of device (e.g., implantable circuit). The electronic device may include at least one of televisions (TVs), digital versatile disk (DVD) players, audios, audio accessory devices (e.g., speakers, headphones, or headsets), refrigerators, air conditioners, cleaners, ovens, microwave ovens, washing machines, air cleaners, set-top boxes, home automation control panels, security control panels, game consoles, electronic dictionaries, electronic keys, camcorders, or electronic picture frames.

The electronic device may include at least one of navigation devices, satellite navigation system (e.g., global navigation satellite system (GNSS)), event data recorders (EDRs) (e.g., black box for a car, a ship, or a plane), vehicle infotainment devices (e.g., head-up display for vehicle), industrial or home robots, drones, automatic teller machines (ATMs), point of sales (POS) devices, measuring instruments (e.g., water meters, electricity meters, or gas meters), or Internet of things (IoT) devices (e.g., light bulbs, sprinkler devices, fire alarms, thermostats, or street lamps). The electronic device of the disclosure may not be limited to the above-described devices, and may provide functions of a plurality of devices like smartphones which has measurement function of personal biometric information (e.g., heart rate or blood glucose). In this disclosure, the term "user" may refer to a person who uses an electronic device or to an artificial intelligence (AI) electronic device that uses the electronic device.

Referring to FIG. 10, the electronic device 1001 in the network environment 1000 may communicate with an electronic device 1002 over a first network 1098 (e.g., a short range wireless communication network) or may communicate with an electronic device 1004 or a server 1008 over a second network 1099 (e.g., a long distance wireless communication network). The electronic device 1001 may communicate with the electronic device 1004 through the server 1008. The electronic device 1001 may include a processor 1020, a memory 1030, an input device 1050, a sound output device 1055, a display device 1060, an audio module 1070, a sensor module 1076, an interface 1077, a haptic module 1079, a camera module 1080, a power management module 1088, a battery 1089, a communication module 1090, a subscriber identification module (SIM) card 1096, and an antenna module 1097. At least one of the components may be omitted from the electronic device 1001, or one or more other suitable components may be further included in the electronic device 1001. Some of the components may be implemented with a single integrated circuit. For example, the sensor module 1076 (e.g., a fingerprint sensor, an iris sensor, or an illumination sensor) may be embedded in the display device 1060.

The processor 1020 may execute a program 1040 to control at least one other hardware or software component of the electronic device 1001 connected to the processor 1020, and may perform various data processing or operations. As at least a part of the data processing or operations, the processor 1020 may load a command or data received from any other component to a volatile memory 1032, may process the command or data stored in the volatile memory 1032, and may store processed data in a nonvolatile memory 1034. The processor 1020 may include a main processor 1021 (e.g., a CPU or an AP) and an auxiliary processor 1023 (e.g., a graphic processing device, an ISP, a sensor hub processor, or a CP), which may be operated independently of or together with the main processor 1021. Additionally or alternatively, the auxiliary processor 1023 may be configured to use lower power than the main processor 1021 or to be specialized for a specified function. The auxiliary processor 1023 may be implemented separately from or as a part of the main processor 1021.

The auxiliary processor 1023 may control at least a part of a function or states associated with at least one component of the electronic device 1001 instead of the main processor 1021 while the main processor 1021 is in an inactive (e.g., sleep) state and together with the main processor 1021 while the main processor 1021 is in an active (e.g., an application execution) state. The auxiliary processor 1023 (e.g., an ISP or a CP) may be implemented as a part of any other component which is functionally (or operatively) associated with the auxiliary processor 1023.

The memory 1030 may store data which is used by at least one component of the electronic device 1001. The data may include the program 1040, or input data or output data associated with a command of the software. The memory 1030 may include the volatile memory 1032 or the nonvolatile memory 1034.

The program 1040 may be stored in the memory 1030 as software and may include an operating system 1042, a middleware 1044, or an application 1046.

The input device 1050 may receive a commands or data which will be used by a component of the electronic device 1001, from the outside (e.g., a user) of the electronic device 1001. The input device 1050 may include a microphone, a mouse, or a keyboard.

The sound output device 1055 may output a sound signal to the outside of the electronic device 1001. The sound output device 1055 may include a speaker or a receiver. The speaker may be used for a general purpose such as multimedia play or recording play, and the receiver may be used to receive an incoming call. The receiver may be implemented separately from the speaker or may be implemented as a part of the speaker.

The display device 1060 may visually provide information to the user of the electronic device 1001. The display device 1060 may include a display, a hologram device, or a control circuit for controlling a projector and a corresponding device. The display device 1060 may include a touch circuitry configured to sense a touch, or a sensor circuitry (e.g., a pressure sensor) configured to measure the strength of force generated by the touch.

The audio module 1070 may convert sound to an electrical signal, or reversely, may convert an electrical signal to sound. The audio module 1070 may obtain sound through the input device 1050, or may output sound through the sound output device 1055, or through an external electronic device 1002 (e.g., a speaker or a headphone) directly or wirelessly connected with the electronic device 1001.

The sensor module 1076 may sense an operation state (e.g., power or a temperature) of the electronic device 1001 or an external environment state, and may generate an electrical signal or a data value corresponding the sensed state. The sensor module 1076 may include a gesture sensor, a grip sensor, a barometric pressure sensor, a magnetic sensor, an acceleration sensor, a grip sensor, a proximity sensor, a color sensor, an infrared (IR) sensor, a biometric sensor, a temperature sensor, a humidity sensor, or an illumination sensor.

The interface 1077 may support one or more specified protocols that may be used to directly and wirelessly connect the electronic device 1001 with an external electronic device 1002. The interface 1077 may include an HDMI, a USB, an SD card, or an audio interface.

A connection terminal 1078 may include a connector that may allow the electronic device 1001 to be physically connected with an external electronic device 1002. The connection terminal 1078 may include a HDMI connector, a USB connector, an SD card connector, or an audio connector (e.g., a headphone connector).

The haptic module 1079 may convert an electrical signal to a mechanical stimulation (e.g., vibration or movement) or an electrical stimulation which the user may perceive through the sense of touch or the sense of movement. The haptic module 1079 may include a motor, a piezoelectric sensor, or an electrical stimulation device.

The camera module 1080 may photograph a still image and a video. The camera module 1080 may include one or more lenses, image sensors, ISPs, or flashes (or electrical flashes).

The power management module 1088 may manage the power which is supplied to the electronic device 1001. The power management module 1088 may be implemented as at least a part of a power management integrated circuit (PMIC).

The battery 1089 may power at least one component of the electronic device 1001. The battery 1089 may include a primary cell not recharged, a secondary cell rechargeable, or a fuel cell.

The communication module 1090 may establish a direct (or wired) communication channel or a wireless communication channel between the electronic device 1001 and an external electronic device or may perform communication through the established communication channel. The communication module 1090 may include one or more CPs which is operated independently of the processor 1020 (e.g., an AP) and supports direct (or wired) communication or wireless communication. The communication module 1090 may include a wireless communication module 1092 (e.g., a cellular communication module, a short range wireless communication module, or a global navigation satellite system (GNSS) communication module) or a wired communication module 1094 (e.g., a local area network (LAN) communication module or a power line communication module). A corresponding communication module of such communication modules may communicate with an external electronic device over the first network 1098 (e.g., a short range communication network such as Bluetooth™, wireless fidelity (Wi-Fi) direct, or infrared data association (IrDA)) or the second network 1099 (e.g., a long distance communication network such as a cellular network, an Internet, or a computer network (e.g., LAN or WAN)), wherein the first antenna and the conductive member transmit and receive a signal of at least one of long term evolution (LTE), Bluetooth™, Wi-Fi, global positioning system (GPS), and wireless code division multiple access (WCDMA).

The above-described types of communication modules may be integrated in a single chip or may be implemented with a plurality of chips which are independent of each other. The wireless communication module 1092 may verify and authenticate the electronic device 1001 within a communication network, such as the first network 1098 or the second network 1099, by using subscriber information (e.g., international mobile subscriber identity (IMSI)) stored in the SIM card 1096.

The antenna module 1097 may transmit a signal or a power to the external electronic device or may receive a signal or a power from the outside. The antenna module 1097 may include one or more antennas, and at least one antenna which is suitable for a communication scheme used in a computer network such as the first network 1098 or the second network 1099 may be selected by the communication module 1090 from the one or more antennas. The signal or power may be exchanged between the communication module 1090 and an external electronic device through the selected at least one antenna or may be received from the external electronic device through the selected at least one antenna and the communication module 1090.

At least some of the components may be connected to each other through a communication scheme (e.g., a bus, a general purpose input and output (GPIO), a serial peripheral interface (SPI), or a mobile industry processor interface (MIPI)) between peripheral devices and may exchange signals (e.g., commands or data) with each other.

A command or data may be transmitted or received (or exchanged) between the electronic device 1001 and the external electronic device 1004 through the server 1008 connecting to the second network 1099. Each of the electronic devices 1002 and 1004 may be the same as or a different from a type of the electronic device 1001. All or a part of operations to be executed in the electronic device 1001 may be executed in one or more external devices of the external electronic devices 1002, 1004, or 1008. For example, when the electronic device 1001 should perform any function or service automatically or in response to a request from the user or any other device, the electronic device 1001 may request one or more external electronic devices to perform at least a part of the function or service, instead of internally executing the function or service or additionally. The one or more external electronic devices which receive the request may execute at least a part of the function or service thus requested or an additional function or service associated with the request, and may provide a result of the execution to the electronic device 1001. The electronic device 1001 may process received result as it is or additionally, and may provide a result of the processing as at least a part of the response to the request. To this end, a cloud, distributed, or client-server computing technology may be used.

The electronic device according to embodiments may be various types of devices, including but not limited to a portable communication device (e.g., a smartphone), a computer device, a portable multimedia device, a mobile medical appliance, a camera, a wearable device, and a home appliance.

The term "module" used in the disclosure may include a unit implemented in hardware, software, or firmware and may be interchangeably used with the terms "logic", "logical block", "part" and "circuit". The "module" may be a minimum unit of an integrated part or may be a part thereof. The "module" may be a minimum unit for performing one or more functions or a part thereof. For example, The "module" may include an application-specific integrated circuit (ASIC).

Embodiments of the disclosure may be implemented by software including an instruction stored in a machine-readable storage medium readable by a machine. For example, the processor of a machine may call the instruction from the machine-readable storage medium and execute the instructions thus called. This means that the machine may perform at least one function based on the called at least one instruction. The one or more instructions may include a code generated by a compiler or executable by an interpreter. The machine-readable storage medium may be provided in the form of non-transitory storage medium. The term "non-transitory", as used herein, indicates that the storage medium is tangible, but does not include a signal. The term "non-transitory" does not differentiate a case where the data is permanently stored in the storage medium from a case where the data is temporally stored in the storage medium.

The method according to embodiments in the disclosure may be provided as a part of a computer program product that may be traded between a seller and a buyer as a product. The computer program product may be distributed in the form of machine-readable storage medium (e.g., a compact disc read only memory (CD-ROM)) or may be directly distributed (e.g., download or upload) online through an application store (e.g., a Play Store™) or between two user devices (e.g., the smartphones). In the case of online distribution, at least a portion of the computer program product may be temporarily stored or generated in a machine-readable storage medium such as a memory of a manufacturer's server, an application store's server, or a relay server.

Each component (e.g., the module or the program) of the above-described components may include one or plural entities. At least one component of the above components or operations may be omitted, or one or more components or operations may be added. Alternatively or additionally, some components (e.g., the module or the program) may be integrated in one component. In this case, the integrated component may perform the same or similar functions performed by each corresponding components prior to the integration. Operations performed by a module, a programming, or other components may be executed sequentially, in parallel, repeatedly, or in a heuristic method, or at least some operations may be executed in different sequences, omitted, or other operations may be added.

An electronic device according to embodiments may utilize a conductive member formed in the vicinity of a camera module as a radiator by closely disposing the camera module or the conductive member and an antenna pattern. As such, radiation efficiency and a radiation region of an antenna may increase.

The electronic device according to embodiments may add a short-circuited line by connecting at least one conductive gasket to the camera module or the conductive member formed in the vicinity of the camera module.

In the disclosed electronic device, the conductive member and a PCB may be electrically connected by using a gasket. A contact structure using a gasket may be connected to a ground of the PCB. A capacitor may be placed on an electrical path between the gasket and the PCB. The electronic device may secure wireless communication performance by using an inductance and a capacitance decided depending on a connection location of a connection member (e.g., a gasket or a contact switch and a conductive material).

While the disclosure has been shown and described with reference to various embodiments thereof, it will be understood by those skilled in the art that various changes in form and details may be made therein without departing from the scope of the disclosure as defined by the appended claims and their equivalents.

What is claimed is:

1. An electronic device which performs wireless communication, comprising:

a first antenna configured to transmit and receive a signal in a first frequency band;

a conductive member disposed to be spaced from the first antenna as much as a first distance;

a printed circuit board disposed parallel to a first surface of the conductive member;-and at least one conductive connection member interposed between the conductive member and the printed circuit board; and a case disposed parallel to a second surface of the conductive member, wherein the conductive member is gap fed from the first antenna and operates as a radiator for wireless communication wherein the conductive member includes at least one hole exposed to outside of the electronic device through the case, and wherein the at least one hole exposes at least a portion of a camera or a sensor included in the electronic device to the outside.

2. The electronic device of claim 1, wherein the conductive member transmits and receives a signal of a second frequency band.

3. The electronic device of claim 1, wherein the first antenna transmits and receives the signal in the first frequency band, and wherein the conductive member transmits and receives a signal in a second frequency band.

4. The electronic device of claim 1, wherein the at least one conductive connection member includes a first end and a second end, wherein the first end is connected to the first surface of the conductive member, and wherein the second end is connected to a ground of the electronic device through a protection element that prevents a leakage current.

5. The electronic device of claim 4, wherein the second end is connected to a ground of the printed circuit board through at least one capacitor.

6. The electronic device of claim 1, wherein the at least one conductive connection member forms an inductance based on a distance of the at least one conductive connection member from the first antenna.

7. The electronic device of claim 1, wherein the conductive member operates as a planar inverted F antenna.

8. The electronic device of claim 1, wherein the first antenna includes:

a first branch connected to a feeding part;

a second branch connected to the first branch and extended in a different direction from a direction of the first branch;

a third branch extended from the second branch in the direction of the first branch; and a fourth branch extended from the second branch in a direction facing away from the third branch.

9. The electronic device of claim 5, wherein the first branch forms a first electrical path (a) in which the signal is transmitted and received in the first frequency band.

10. The electronic device of claim 9, wherein the second branch and the third branch form a second electrical path (b) for gap feeding to the conductive member, and wherein the second branch and the fourth branch form a third electrical path (c) for gap feeding to the conductive member.

11. The electronic device of claim 10, wherein the first electrical path (a), the second electrical path (b), and the third electrical path (c) have a relationship based on $a<(b \text{ or } c)<(a+\lambda/4)$, and wherein the $\lambda$ is a wavelength of a resonant frequency by the first electrical path (a).

12. The electronic device of claim 8, wherein the third branch and the fourth branch are disposed to be spaced from the conductive member as much as the first distance.

13. The electronic device of claim 12, wherein the third branch and the fourth branch are parallel to a first portion of the conductive member.

14. The electronic device of claim 13, wherein, when the conductive member operates as an antenna radiator, a common mode current with the first branch flows in the third branch.

15. The electronic device of claim 13, wherein, when the conductive member operates as an antenna radiator, a differential mode current with the first branch flows in the first portion.

16. The electronic device of claim 1, wherein the at least one conductive connection member is formed of a gasket of a metal material.

17. The electronic device of claim 1, wherein the at least one conductive connection member is disposed to be spaced from the first antenna as much as $\lambda$ or more, and wherein the $\lambda$, is a wavelength of a resonant frequency by the first antenna.

18. The electronic device of claim 1, wherein the first antenna and the conductive member transmit and receive a signal of at least one of long term evolution (LTE), Bluetooth™, wireless fidelity (WIFI), global positioning system (GPS), and wireless code division multiple access (WCDMA).

* * * * *